US012692862B2

(12) United States Patent
Foss et al.

(10) Patent No.: US 12,692,862 B2
(45) Date of Patent: Jul. 28, 2026

(54) STATIONARY PLUNGER PACKING

(71) Applicant: Halliburton Energy Services, Inc., Houston, TX (US)

(72) Inventors: Michael Foss, Haslet, TX (US); Timothy Holiman Hunter, Wichita Falls, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/999,159

(22) Filed: Dec. 23, 2024

(65) Prior Publication Data

US 2026/0177054 A1 Jun. 25, 2026

(51) Int. Cl.
*F04B 53/16* (2006.01)
*F04B 47/04* (2006.01)

(52) U.S. Cl.
CPC ..... *F04B 53/164* (2013.01); *F04B 47/04* (2013.01)

(58) Field of Classification Search
CPC ..... F04B 53/143; F04B 53/164; F04B 53/22; F04B 47/04; F04B 39/041; F04B 23/06; F16J 15/008
See application file for complete search history.

(56) References Cited

U.S. PATENT DOCUMENTS

| | | | | |
|---|---|---|---|---|
| 3,776,558 | A * | 12/1973 | Maurer | F16J 15/008 277/914 |
| 4,541,638 | A | 9/1985 | Ogawa | |
| 6,394,461 | B1 | 5/2002 | Henderson | |
| 7,343,969 | B1 | 3/2008 | Busch | |
| 11,353,017 | B2 | 6/2022 | Surjaatmadja et al. | |
| 11,415,123 | B2 | 8/2022 | Hunter et al. | |
| 11,441,687 | B2 | 9/2022 | Hurst et al. | |
| 11,761,317 | B2 | 9/2023 | Stephenson et al. | |
| 11,920,579 | B2 | 3/2024 | Surjaatmadja et al. | |
| 12,055,025 | B2 | 8/2024 | Bull et al. | |
| 2009/0041588 | A1 | 2/2009 | Hunter et al. | |
| 2019/0011051 | A1* | 1/2019 | Yeung | F04B 53/10 |

* cited by examiner

*Primary Examiner* — Loren C Edwards

(57) ABSTRACT

A reciprocating pump system includes a fluid end that includes plungers configured to be reciprocated within respective bores in a body. Dynamic packings in each of the bores are configured to be energized into dynamic sealing engagement around respective plungers against pressure from a pressure side. Dynamic packing nuts are engageable with atmospheric sides of respective dynamic packings opposite the pressure side to energize the respective dynamic packings. Static packings in each of the dynamic packing nuts are configured to be energized by mechanical force into static sealing engagement around respective plungers against pressure from a pressure side. While the plungers are reciprocating within the bores, the dynamic packings are energized by the dynamic packing nuts and the static packings are deenergized. When a plunger is not being reciprocated, the respective static packing is energized into static sealing engagement with the respective plunger.

20 Claims, 5 Drawing Sheets

STATIONARY PLUNGER PACKING

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Subterranean operations involve different steps such as, for example, drilling a wellbore at a desired well site, treating and stimulating the wellbore to optimize production of hydrocarbons, and performing the necessary steps to produce and process the hydrocarbons from the subterranean formation.

Drilling as well as treating and stimulating a wellbore can include, among other things, delivering various fluids (along with additives, proppants, gels, cement, etc.) to the wellbore under pressure and injecting those fluids into the wellbore. One example treatment and stimulation operation is a hydraulic fracturing operation in which the fluids are highly pressurized via pumping systems to create fractures in the subterranean formation. The pumping systems typically include crankshaft pumps, which are high-pressure, reciprocating pumps driven through conventional transmissions by diesel engines. These are used due to their ability to provide high torque to the pumps. Unfortunately, large maintenance costs are associated with the fluid ends and transmissions of such pumps used in stimulation operations.

Further, such pumps may include plungers or pistons that travel within the fluid ends to draw in and then displace the fluids into wellbore. The pumps may include, three, five, seven, or more such plungers. Should one plunger fail or need maintenance, the entire pump must be taken offline to service the pump, resulting in the loss of the entire pumping capacity of the pump.

BRIEF DESCRIPTION OF THE DRAWINGS

Aspects of the disclosure are described with reference to the following figures. The same or sequentially similar numbers are used throughout the figures to reference like features and components. The features depicted in the figures are not necessarily shown to scale. Certain features may be shown exaggerated in scale or in somewhat schematic form, and some details of elements may not be shown in the interest of clarity and conciseness.

DETAILED DESCRIPTION

The present disclosure describes embodiments of an improved reciprocating pump that includes a fluid end, in which plungers reciprocate via the operation of a power end to reciprocate respective push rods. The push rods are coupled to the plungers via releasable connectors.

During operation, the plungers reciprocate within bores of the fluid end of the pump. Packing assemblies for each plunger provide an energized dynamic packing to provide a dynamic seal around the plungers to seal against pressure from within the fluid end. The packing assemblies also include a static packing. However, while the plunger is reciprocating, the static packing is not energized. Over time one or more of the plungers may experience performance degradation or failure while the remaining plungers are operating at normal or at least sufficient capacity. Overall, the number of plungers still sufficiently functioning may be able to provide sufficient capacity for the pump to justify continuing to operate the pump, albeit at a reduced capacity. An issue though is that the pump may not be able to continue to operate, even with reduced capacity, due to the degrading or failed plunger. With the concepts of the present disclosure however, the degrading or failed plunger(s) may be taken offline by decoupling the plunger from the respective push rod such that the plunger remains stationary while the pump continues to operate using the rest of the plungers to continue to pump fluid. When the plunger is taken offline and stationary, the dynamic packing may either be degraded or not designed to seal against pressure from within the fluid end. To provide a seal, the static packing is then energized to provide a static seal around the plunger against the pressure from within the fluid end.

Figure 1:
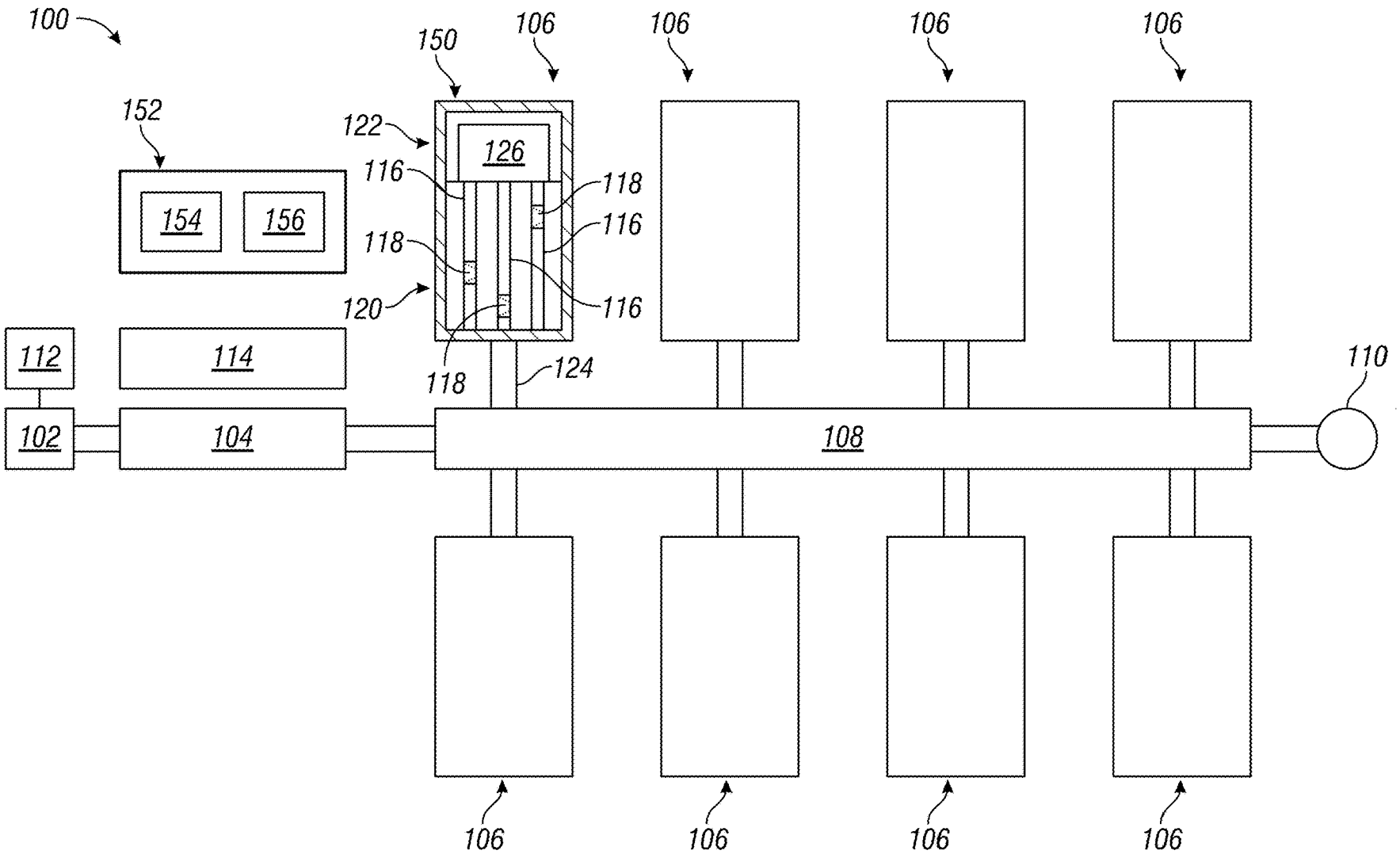
FIG. 1 is a diagram illustrating a system for wellbore treatment and stimulation operations, according to aspects of the present disclosure.

FIG. 1 illustrates an example system 100 for well stimulation operations, according to aspects of the present disclosure. However, the pump systems described may also be used during well drilling or well treatment operations. The system 100 includes a fluid management system 102 in fluid communication with a blender system 104. The blender system 104 may in turn be in fluid communication with one or more pump systems 106 through a fluid manifold system 108. The fluid manifold system 108 may provide fluid communication between the pump systems 106 and a wellbore 110. In use, the fluid management system 102 may receive water or another fluid from a fluid source 112 (e.g., a ground water source, a pond, one or more frac tanks), mix one or more fluid additives into the received water or fluid to produce a treatment fluid with a desired fluid characteristic, and provide the produced treatment fluid to the blender system 104. The blender system 104 may receive the produced treatment fluid from the fluid management system 102 and mix the produced treatment fluid with a proppant, such as sand, or another granular material 114 to produce a final treatment fluid that is directed to the fluid manifold system 108. The pump systems 106 may then pressurize the final treatment fluid to generate pressurized final treatment fluid that is directed into the wellbore 110, where the pressurized final treatment fluid generates fractures within a formation in fluid communication with the wellbore 110.

The pump systems 106 may be any suitable pump systems for well operations. The disclosed pump systems 106 may each include at least three elongated cylindrical plunger bores 116 through which treatment fluid is pressurized via corresponding plungers 118. The plunger bores 116 are part of a fluid end 120 of the pump system 106, and the pump system 106 also includes a power end 122 for supplying motive force for the plungers 118 moving through the plunger bores 116 of the fluid end 120. As shown, the pump system 106 may be a triplex pump having three plunger bores 116. In other embodiments, the pump system 106 may be a quintuplex pump including five bores, a septuplex pump with seven plunger bores, or a pump with even more plunger bores. The power end 122 provides control of the position of the rods/plungers for suction, discharge, and pre-compression modes of operation. That is, the power end 122 is controllable to provide independent movement of the plunger 118 in the forward and return directions within the plunger bore 116. The plunger bores 116 are all fluidly connected to the same suction line 124 of the fluid manifold system 108. Although only one of the pump systems 106 of FIG. 1 is illustrated in detail to show these different parts of the decoupled long stroke pump system, it should be understood that the other pumps 106 of FIG. 1 may feature a similar structure.

The power end 122 of the pump systems 106 may include or be coupled to any desired type of drive system 126. In some embodiments, the drive system 126 may include one or more engines. Since the engines would be run at full speed and would be high on their torque curve, there will be no issues with having enough torque to come online under pressure. This allows the use of diesel engines, spark ignited engines, or turbine engines. The engines may receive energy or fuel in one or more forms from sources at the well site. The energy or fuel may include, for instance, hydrocarbon-based fuel, hydraulic energy, thermal energy, etc. The sources of energy or fuel may include, for instance, on-site fuel tanks, mobile fuel tanks delivered to the site, hydraulic pumping systems, etc. The engines may then convert the fuel or energy into mechanical energy that can be used to drive the associated pump system 106. For example, the engines may power pumps that provide hydraulic fluid to the power end 122 for actuating the plungers 118 of the pump system 106. In other embodiments, the drive system 126 may include an electric motor or an electric driven linear force actuator. The power end 122 of the pump system 106 may utilize any suitable power means for stroking the plungers 118: hydraulics, electric linear motors, roller screws, linear actuator mechanisms, or any other device providing linear power. Also, while the pump systems 106 are described as reciprocating pumps, the pump systems 106 may also include hydraulically driven intensifier pumps and double acting linear pumps with dual fluid ends.

As illustrated, the pump system 106 may include a skid or trailer 150 onto which all components of the pump system 106 are mounted. For example, the fluid end 120 and power end 122 are mounted on the skid or trailer 150. This arrangement may enable the pump system 106 to be assembled at a different location and transported to the well site in one piece. The skid or trailer 150 may include multiple separate skids/trailers that are transported individually to the well site and easily assembled there.

In one or more embodiments, the pump systems 106 may be communicatively coupled to a controller 152 that directs the operation of the power end 122 of the pump systems 106. The controller 152 may include, for instance, an information handling system that sends one or more control signals to the pump systems 106 to control the components of the drive system 126 and/or the power end 122. For example, in embodiments where the drive system 126 provides hydraulic force to the power end 122, the controller 152 may output control signals to the drive system 126 for controlling the amount of hydraulic force communicated. Additionally, or alternatively, the controller 152 may output control signals to various valves (not shown) within the power end 122 to control the mode of operation of the plunger bores 116.

As used herein, an information handling system may include any system containing a processor 154 and a memory device 156 coupled to the processor 154. The memory device 156 contains a set of instructions that, when executed by the processor 154, cause the processor 154 to perform certain functions. The control signals may take whatever form (e.g., electrical, hydraulic, pneumatic) is necessary to communicate with the associated drive system 126 and/or power end 122. For instance, a control signal to the drive system 126 may include a hydraulic or pneumatic control signal to one or more variable control valves, which may receive the control signal and alter the operation of the drive system 126 based on the control signal. In other embodiments, a control signal to the drive system 126 may include an electrical control signal to one or more electric linear motors, roller screws, or long stroke linear mechanisms, which may receive the control signal and alter the operation of the drive system 126 based on the control signal. Similarly, control signals in the form of hydraulic, pneumatic, or electrical control signals may be communicated to valves, linear actuators, or other components of the power end 122.

In one or more embodiments, the controller 152 may also be communicatively coupled to other elements of the system, including the fluid management system 102, the blender system 104, and the pump systems 106 to monitor and/or control the operation of the entire system 100. In other embodiments, some or all the functionality associated with the controller 152 may be located on the individual elements of the system, e.g., each of the pump systems 106 may have individual controllers that direct the operation of the associated drive systems 126 and/or power ends 122.

Figure 2A:
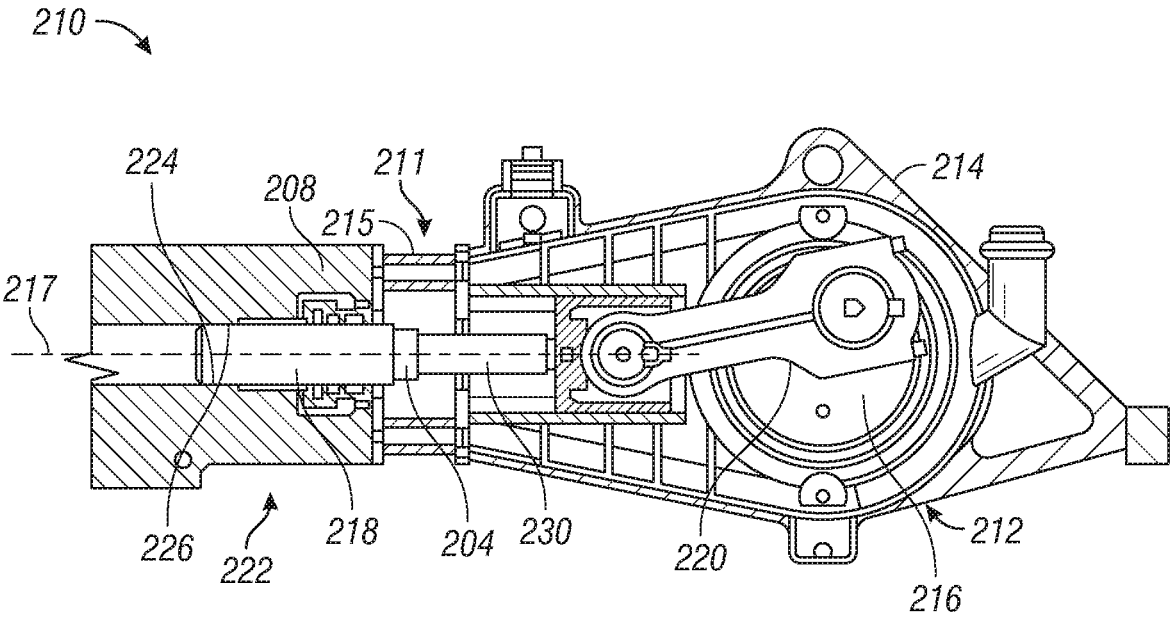
FIGS. 2A and 2B are cut-away illustrations of a power end and a cross-bore fluid end of a reciprocating pump, according to aspects of the present disclosure.
Figure 2B:
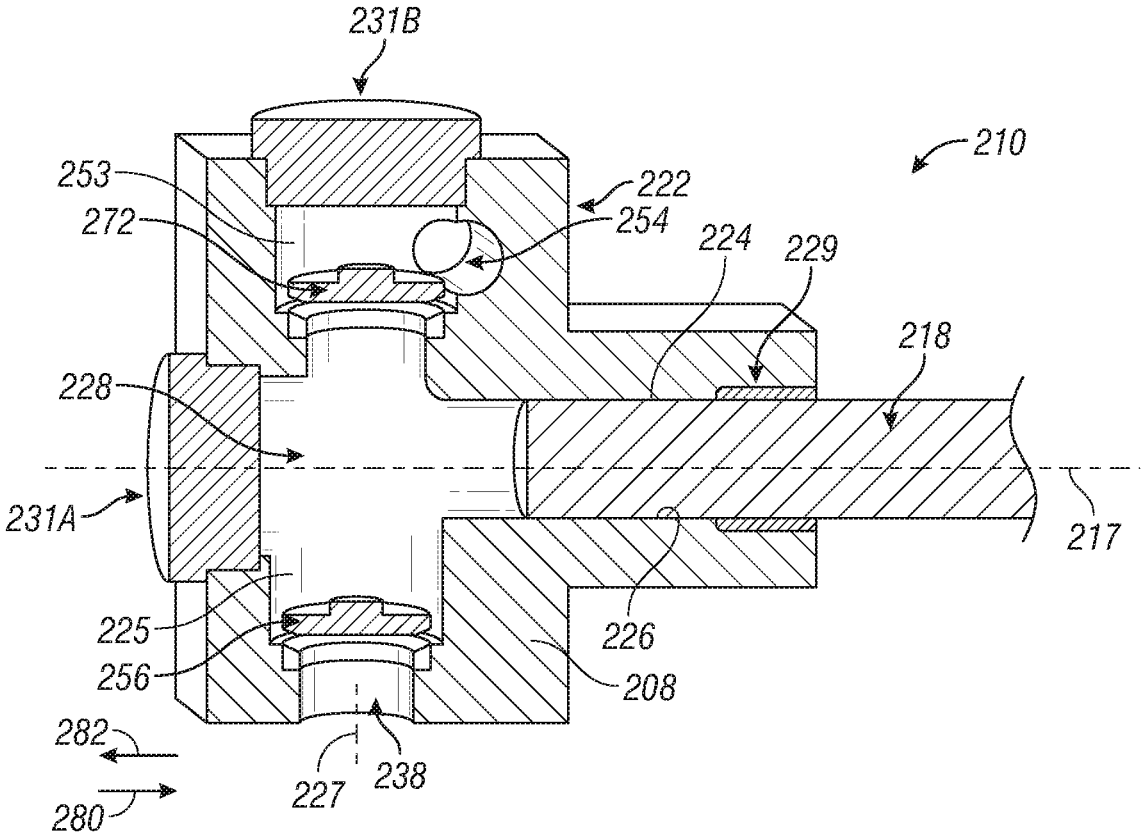

FIGS. 2A and 2B illustrate a pump 210 comprising a pump fluid end 222 and a pump power end 212. The pump fluid end 222 comprises a plunger bore 224 in which a plunger 218 can be reciprocated along a central axis 217 via the pump power end 212. The reciprocation is via coupling of the plunger 218 to a pushrod 230, crank arm 220, and crankshaft 216 of the pump power end 212. A releasable connector 204 (discussed below) may be used to couple the plunger 218 to the pump power end 212 (e.g., to the pushrod 230). Although not shown in FIGS. 2A and 2B, the pump 210 also includes a retainer operable to selectively engage the plunger 218 to prevent movement of the plunger 218 toward the power end 212. The retainer is discussed in more detail below with respect to FIGS. 3A-3E.

The pump 210 may comprise any suitable pump power end 212 for enabling the pump 210 to perform pumping operations (e.g., pumping a wellbore servicing fluid downhole). Similarly, the pump 210 may include any suitable housing 214 for containing and/or supporting the pump power end 212 and components thereof. The housing 214 may comprise various combinations of inlets, outlets, channels, and the like for circulating and/or transferring fluid. Additionally, the housing 214 may include connections to other components and/or systems, such as, but not limited to, pipes, tanks, drive mechanisms, etc. Furthermore, the housing 214 may be configured with cover plates or entryways for permitting access to the pump power end 212 and/or other pump components. As such, the pump 210 may be inspected to determine whether parts need to be repaired or replaced. The pump power end 212 may also be hydraulically or pneumatically driven, whether it is a non-intensifying or an intensifying system.

Those skilled in the art will understand that the pump power end 212 may include various components commonly employed in pumps. The pump power end 212 can be any suitable pump known in the art and with the help of this disclosure to be operable to reciprocate the plunger 218 in the plunger bore 224. For example, without limitation, the pump power end 212 can be operable via and comprise a crank and slider mechanism, a powered hydraulic/pneumatic/steam cylinder mechanism or various electric, mechanical, or electro-mechanical drives. For example, the pump power end 212 may include a rotatable crankshaft 216 attached to at least one plunger 218 (e.g., a plunger or piston) by way of a crank arm/connecting rod 220 and a pushrod 230. Additionally, an engine (e.g., a diesel engine), motor (e.g., electric motor), or other suitable power source (not shown) may be operatively connected to the crankshaft 216 (e.g., through a transmission and drive shaft) and operable to actuate rotation thereof. In operation, rotation of the crankshaft 216 induces translational movement of the crank arm/connecting rod 220, thereby causing the pushrod 230 and thus the plunger 218 to extend and retract along a path, which may generally be defined by the central axis 217 within the plunger bore 224 (sometimes referred to herein for brevity as a "plunger bore 224" or simply a "bore 224", although not wishing to be limited to a particular plunger 18). The pump 210 is typically mounted on a movable structure such as a semi-tractor trailer or skid, and the moveable structure may contain additional components, such as a motor or engine (e.g., a diesel engine), that provides power (e.g., mechanical motion) to the pump power end 212.

The pump fluid end 222 includes a fluid end body 208 and may be integrated with the pump power end 212 via an integration section 211 positioned in a space between the pump fluid end 22 and the pump power end 12 and safeguarded (e.g., from personnel) via a cover 215. The plunger bore 224 is at least partially defined by a cylinder wall 226. As described further hereinbelow with reference to FIGS. 2A and 2B, the pump fluid end 222 can be a cross-bore pump fluid end 222 or, alternatively, an in-line or "concentric" bore pump fluid end. As utilized herein, cross-bore pump fluid ends can comprise "T-bore" pump fluid ends, "X-bore" (e.g., cross shaped bore) pump fluid ends, or "Y-bore" pump fluid ends. As discussed further below, the pump 210 includes at least one fluid inlet 238 for receiving fluid from a fluid source, e.g., a suction line, suction header, storage or mix tank, blender, discharge from a boost pump such as a centrifugal pump, etc. The pump 210 also includes at least one discharge outlet 254 for discharging fluid to a discharge source, e.g., a flowmeter, pressure monitoring and control system, distribution header, discharge line, wellhead, discharge manifold pipe, and the like.

In embodiments, the plunger 218 comprises a plunger or a piston. While the plunger 218 may be described herein with respect to embodiments comprising a plunger, it is to be understood that the plunger 218 may comprise any suitable component for displacing fluid. As those skilled in the art will readily appreciate, a plunger-type pump generally employs fixed seals (e.g., packing assemblies 229) through which the plunger moves during each stroke (e.g., return stroke or forward stroke).

While this discussion focuses on a pump fluid end 222 comprising a single plunger 218 disposed in a single plunger bore 224, it is to be understood that the pump fluid end 222 includes multiple plungers 218 and associated plunger bores 224. In such a multi-bore pump, each plunger bore 224 may be associated with a respective plunger 218 and a crank arm 220, and a single common crankshaft 216 may drive each of the plurality of plungers 218 and crank arms 220. Alternatively, a multi-bore pump may include multiple crankshafts 216, such that each crankshaft 216 may drive a corresponding plunger 218. Furthermore, the pump 210 may be implemented as any suitable type of multi-bore pump. In a non-limiting example, the pump 210 may comprise a triplex pump having three plungers 218 and associated plunger bores 224, discharge valve assemblies 272 (discussed below) and suction valve assemblies 256 (discussed below). The pump 210 may also include any number of additional plungers, such as a quintuplex pump having five plungers 218 and five associated plunger bores 224, discharge valve assemblies 272 and suction valve assemblies 256. The pump 210 may even have, for example, seven or nine plungers 218.

As appreciated by those skilled in the art, the plunger 218 may include any suitable size and/or shape for extending and retracting along a path within the pump fluid end 222. For instance, plunger 218 may comprise a generally cylindrical shape, and may be sized such that the plunger 218 can sufficiently slide against or otherwise interact with the inner cylinder wall 226. The pump fluid end 222 may include any other suitable component(s) and/or structure(s) for containing and/or supporting the plunger 218 and providing the cylinder wall 226 at least partially defining the plunger bore 224 along which the pump power end 212 can reciprocate the plunger 218 during operation of the pump 210.

The plunger bore 224 can have an inner diameter slightly greater than the outer diameter of the plunger 218, such that the plunger 218 may sufficiently reciprocate within plunger bore 224. In embodiments, the fluid end body 208 of the pump fluid end 222 may have a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 208 of pump fluid end 222 may be cast, forged or formed from any suitable materials, e.g., steel, metal alloys, or the like. Those skilled in the art will recognize that the type and condition of material(s) suitable for the fluid end body 208 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 208 (e.g., cylinder wall 226 defining at least a portion of plunger bore 224 and/or pump chamber 228) may include protective coatings for preventing and/or resisting abrasion, erosion, and/or corrosion.

In embodiments, the cylindrical shape (e.g., providing cylindrical wall(s) 226) of the fluid end body 208 may be pre-stressed in an initial compression. Moreover, a high-pressure bore(s) providing the cylindrical shape (e.g., providing cylindrical wall(s) 226) may comprise one or more sleeves (e.g., heat-shrinkable sleeves). Additionally, or alternatively, the high-pressure bore(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The bores and cylindrical-shaped components (e.g., providing cylindrical wall 226) associated with the pump fluid end body 208 of pump fluid end 222 may be held in place within the pump 210 using any appropriate technique. For example, components may be assembled and connected, e.g., bolted, welded, etc. Additionally, or alternatively, the bores may be in components that may be press-fit into openings machined or cast into the pump fluid end 222 or other suitable portion of the pump 210. Such openings may be configured to accept and rigidly hold bores (e.g., having cylinder wall(s) 226 at least partially defining plunger bore 224) in place to facilitate interaction of the plunger 18 and other components associated with the pump 210.

The bore 224 may be in fluid communication with a discharge chamber 253 formed within the pump fluid end 222. Such a discharge chamber 253, for example, may be configured as a pressurized discharge chamber 253 having a discharge outlet 254 through which fluid is discharged by the plunger 218. Thus, the plunger 218 may be movably disposed within the plunger bore 224, which may provide a fluid flow path into and/or out of the pump chamber. During operation of the pump 210, the plunger 218 may be configured to reciprocate along a path (e.g., along central axis 217 within the bore 224 and/or a pump chamber 228) to transfer a supply of fluid to the pump chamber 228 and/or discharge fluid from the pump chamber 228. The pump fluid end 222 also comprises at least one valve assembly for controlling the receipt and output of fluid. For example, the pump fluid end 222 can comprise a suction valve assembly 256 and a discharge valve assembly 272 associated with each plunger 218.

With FIG. 2B showing a cross-bore pump fluid end 222 engaged with a plunger 218, the cross-bore pump fluid end 222 comprises the cross-bore fluid end body 208, a cross-bore pump chamber 228, a suction valve assembly 256, and a discharge valve assembly 272. In this cross-bore configuration, the suction valve assembly 256 and discharge valve assembly 272 are in a bore or channel 225 (also referred to herein as a cross bore 225) of the pump chamber 228, wherein the bore 225 has a central axis 227 that is perpendicular to the bore 224. The pump 210 may also comprise one or more access ports. For example, with reference to the cross-bore fluid end body 208 embodiment of FIG. 2B, a front access port 231A can be located on a front of the pump fluid end 222. A top or side access port 231B can be located on a top of the pump fluid end 222 and on a side (e.g., top side) of the discharge valve assembly 272 opposite suction valve assembly 256.

In embodiments, packing assemblies 229 may be arranged around the plunger 218 to provide sealing between the outer walls of the plunger 218 and the inner walls 226 defining at least a portion of the plunger bore 224. Those skilled in the art will recognize that the seals may comprise any suitable type of seals, and the selection of seals may depend on various factors e.g., fluid, temperature, pressure, etc. More details on the packing assemblies 229 are discussed below.

As noted above, the pump fluid end 222 comprises the suction valve assembly 256. The suction valve assembly 256 may alternately open or close to permit or prevent fluid flow. Those skilled in the art will understand that the suction valve assembly 256 may be of any suitable type or configuration (e.g., gravity- or spring-biased, flow activated, etc.). Those skilled in the art will also understand that the suction valve assembly 256 may be disposed within the pump fluid end 222 at any suitable location therein. For instance, the suction valve assembly 256 may be disposed within the bore 225 below the central axis 217 of the pump fluid end 222, in cross-bore pump fluid end 222 designs such as FIG. 2B, such that a suction valve body of the suction valve assembly 256 moves away from a suction valve seat within the a suction valve seat housing of plunger 218 when the suction valve assembly 256 is in an open configuration and toward the suction valve seat when the suction valve assembly 256 is in a closed configuration.

The pump 210 also comprises the discharge valve assembly 272 for controlling the output of fluid through the discharge chamber 253 and the discharge outlet 254. Analogous to the suction valve assembly 256, the discharge valve assembly 272 may alternately open or close to permit or prevent fluid flow. Those skilled in the art will understand that the discharge valve assembly 272 may be disposed within the pump chamber at any suitable location therein. For instance, the discharge valve assembly 272 may be disposed within the bore 225 proximal the top of the pump fluid end 22, in cross-bore pump fluid end 222 designs such as FIG. 2B, such that a discharge valve body of the discharge valve assembly 272 moves toward the discharge chamber 253 when the discharge valve assembly 272 is in an open configuration and away from the discharge chamber 253 when the discharge valve assembly 272 is in a closed configuration. In addition, the discharge valve assembly 272 may be along the central axis 227 of the bore 225 perpendicular to central axis 217 in cross-bore pump fluid end 222 configurations such as FIG. 2B.

Further, the suction valve assembly 256 and the discharge valve assembly 272 can comprise any suitable mechanism for opening and closing valves. For example, the suction valve assembly 256 and the discharge valve assembly 272 can comprise a suction valve spring and a discharge valve spring, respectively. Additionally, any suitable structure (e.g., valve assembly comprising sealing rings, stems, poppets, etc.) and/or components may be employed suitable means for retaining the components of the suction valve assembly 256 and the components of the discharge valve assembly 72 within the pump fluid end 222 may be employed.

The fluid inlet 238 may be arranged within any suitable portion of the pump fluid end 222 and configured to supply fluid to the pump in any direction and/or angle. Moreover, the pump fluid end 222 may comprise and/or be coupled to any suitable conduit (e.g., pipe, tubing, or the like) through which a fluid source may supply fluid to the fluid inlet 238. The pump 210 may comprise and/or be coupled to any suitable fluid source for supplying fluid to the pump via the fluid inlet 238. In embodiments, the pump 210 may also comprise and/or be coupled to a pressure source such as a boost pump (e.g., a suction boost pump) fluidly connected to the pump 210 (e.g., via the inlet 238) and operable to increase or "boost" the pressure of fluid introduced to the pump 210 via the fluid inlet 238. A boost pump may comprise any suitable type including, but not limited to, a centrifugal pump, a gear pump, a screw pump, a roller pump, a scroll pump, a piston/plunger pump, or any combination thereof. For instance, the pump 210 may comprise and/or be coupled to a boost pump known to operate efficiently in high-volume operations and/or may allow the pumping rate therefrom to be adjusted. Those skilled in the art will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of the pump 210 at about said pressures. Additionally, or alternatively, the boost pump may have a flow rate of greater than or equal to about 80 BPM, about 70 BPM, and/or about 50 BPM.

The multiple plungers may receive a supply of fluid from any suitable fluid source, which may be configured to provide a constant fluid supply. Additionally, or alternatively, the pressure of supplied fluid may be increased by adding pressure (e.g., boost pressure) as described previously. In embodiments, the fluid inlet(s) 238 receive a supply of pressurized fluid comprising a pressure ranging from about 30 psi to about 300 psi.

In embodiments, the pump fluid end 222 may comprise an external manifold (e.g., a suction header) for feeding fluid to the multiple reciprocating assemblies via any suitable inlet(s). Additionally, or alternatively, the pump fluid end 222 may comprise separate conduits such as hoses fluidly connected to separate inlets for inputting fluid to each reciprocating assembly. Of course, numerous other variations may be similarly employed, and therefore, fall within the scope of the present disclosure. Additionally, or alternatively, the discharge outlets 254 may be fluidly connected to a common collection point such as a sump or distribution manifold, which may be configured to collect fluids flowing out of the fluid outlets 254, or another bore bank and/or one or more additional pumps.

In operation, the plunger 218 extends and retracts along a path to alternate between providing forward strokes in a forward direction (also referred to as discharge strokes and correlating to movement in a positive direction along the central axis 217) and return strokes in a return direction (also referred to as suction strokes and correlating to movement in a negative direction along the central axis 217), respectively. During a forward stroke, the plunger 218 extends away from the pump power end 212 and toward the pump fluid end 222 as indicated by arrow 280. Before the forward stoke begins, the plunger 218 is in a fully retracted position (also referred to as bottom dead center (BDC) with reference to the crankshaft 216), in which case the suction valve assembly 256 can be in a closed configuration having allowed fluid to flow into the (e.g., high pressure) pump chamber 228. (As utilized herein, "high pressure" indicates possible subjection to high pressure during discharge.) When discharge valve assembly 272 is in a closed configuration (e.g., under the influence of a closing mechanism, such as a spring), the high pressure in a discharge pipe or manifold containing discharge outlet 254 prevents fluid flow into discharge chamber 253 and causes pressure in the pump chamber 228 to accumulate upon stroking of the plunger 218. When the plunger 218 begins the forward stroke, the pressure builds inside the pump chamber 228 and acts as an opening force that results in positioning of the discharge valve assembly 272 in an open configuration, while a closing force (e.g., via a closing mechanism, such as a spring and/or pressure increase inside pump chamber 228) urges the suction valve assembly 256 into a closed configuration. When utilized in connection with a valve assembly, "open" and "closed" refer, respectively, to a configuration in which fluid can flow through the valve assembly (e.g., can pass between a valve body and a valve seat thereof) and a configuration in which fluid cannot flow through the valve assembly (e.g., cannot pass between a valve body and a valve seat thereof). As the plunger 218 extends forward, fluid within the pump chamber 228 is discharged through the discharge outlet 254.

During a return stroke, the plunger 218 reciprocates or retracts away from the pump fluid end 222 and towards the pump power end 212 of the pump 210 as indicated by arrow 280. Before the return stroke begins, the plunger 218 is in a fully extended position (also referred to as top dead center (TDC) with reference to the crankshaft 216), in which case the discharge valve assembly 272 can be in a closed configuration having allowed fluid to flow out of the pump chamber 228 and the suction valve assembly 256 is in a closed configuration. When the plunger 218 begins and retracts towards the pump power end 212, the discharge valve assembly 272 assumes a closed configuration, while the suction valve assembly 256 opens. As the plunger 218 moves away from the discharge valve assembly 272 during a return stroke, fluid flows through the suction valve assembly 256 and into the pump chamber 228.

The multiple plungers 218 can be angularly offset of phase-shifted to ensure that no two plungers are located at the same position along their respective stroke paths (i.e., the plungers are "out of phase") to improve fluid intake for each plunger 218. For example, the plungers may be angularly distributed to have a certain offset (e.g., 360 degrees divided by the number of plungers such as 120 degrees of separation in a triplex pump). This distribution minimizes undesirable effects that may result from multiple plungers of a single pump simultaneously producing pressure pulses and ensures the multiple plungers 218 receive fluid and/or a certain quantity of fluid at all times of operation. The position of a plunger is generally based on the number of degrees a pump crankshaft (e.g., crankshaft 16) has rotated from a bottom dead center (BDC) position. The BDC position corresponds to the position of a fully retracted plunger at zero velocity, e.g., just prior to a plunger moving (i.e., in a direction indicated by arrow 282 in FIG. 2B) forward in its bore. A top dead center position corresponds to the position of a fully extended plunger at zero velocity, e.g., just prior to a plunger moving backward (i.e., in a direction indicated by arrow 280 in FIGS. 2A and 2B) in its bore. Accordingly, when one plunger 218 is at its maximum forward stroke position, a second plunger 218 will be 60 degrees through its discharge stroke from BDC, and a third plunger 218 will be 120 degrees through its suction stroke from top dead center (TDC).

Figure 3:
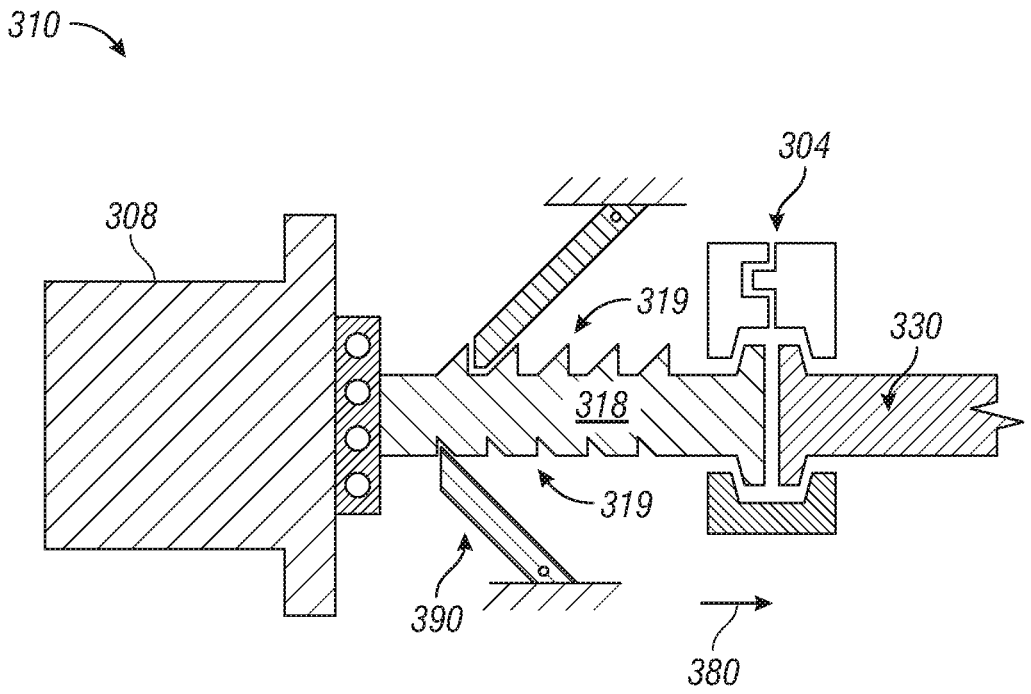
FIG. 3 is an illustration of an exemplary pump fluid end with retainers and a connector, according to aspects of the present disclosure.

FIG. 3 is an embodiment of a reciprocating pump 310 with components and operations similar to the reciprocating pumps 106 and 210 discussed above. Similar components are given similar reference numbers as above; e.g., the pump 310 is similar to the pump 210. Since already discussed and for conciseness, not all the discussions of the components or operations will be repeated. The pump 310 includes a fluid end housing 308, in which a plunger 318 reciprocates via the operation of a power end (not shown) to reciprocate a push rod 330. The push rod 330 is coupled to the plunger 318 via a connector 304 releasably coupling the push rod 330 and the plunger 318. The pump 310 also includes a retainer 390 for each of the plungers 318. The retainers 390 are independently operable to selectively engage an engagement profile 319 of a respective plunger 318 to prevent the respective plunger 318 from traveling in the return direction as shown by the arrow 380.

During operation of the pump 310, one or more of the plungers 318 may experience performance degradation or failure while the remaining plungers 318 are operating at normal or at least sufficient capacity. Overall, the number of plungers 318 still sufficiently functioning may be able to provide sufficient capacity for the pump 310 to justify continuing to operate the pump 310 at a reduced capacity. An issue though is that the pump 310 may not be able to continue to operate, even with reduced capacity, due to the degrading or failed plunger 318. With the concepts of the present disclosure however, the degrading or failed plunger(s) 318 may be taken offline and remain stationary while the pump 310 continues to operate using the rest of the plungers 318 to continue to pump fluid. To do so, the plunger(s) 318 experiencing insufficient performance is identified based on measured operating metrics of the pump 310 that indicate a current or are used by a model to predict a future sufficient degradation or failure of the plunger(s) 318. The respective retainer(s) 390 for the identified plunger(s) 318 is then operated to move into engagement with the plunger 318 being taken offline. Once engaged, the retainer 390 prevents the plunger 318 from movement in the return direction. Also, the connector 304 allows the decoupling of a plunger 318 from a respective push rod 330 such that the pump 310 can continue to operate and reciprocate all the push rods 330 but without reciprocating the plunger 318 to be taken offline. The engagement profile 319 of each plunger 318, the retainer 390, and the releasable connector 304 may be any suitable form for retaining the plunger 318 and releasing the push rod 330.

As shown in FIG. 3, the engagement profile 319 of each plunger 318 may include external or internal teeth; e.g., ratchet teeth, along a portion of the plunger 318. Correspondingly, the retainer 390 includes one or more arms or pawls rotationally connected to a stationary portion of the pump 310. For normal pump operation, the pawls are selectively held in place out of engagement with the plunger 318 by any suitable means such as a spring, locking mechanism, actuator, or other device. The pawls are also rotatable about a pin or other suitable hinge by being gravity- or spring-biased or by an actuator (not shown) using hydraulic, mechanical, or electrical power to provide rotational force to the pawls. Upon identifying a plunger 318 for decoupling, the pawls may be released or actuated into engagement with the engagement profile 319 of the plunger 318 using gravity or spring force or using the actuator (not shown). The actuator may be remotely actuated using the controller 152 (FIG. 1) and may also be automatically controlled based on measured operating metrics of the pump 310 that indicate a current or are used by a model to predict a future sufficient degradation or failure of the plunger 318. After completing a forward stroke, the push rod 330 exerts force on the plunger 318 in the return direction. Doing so allows the push rod 330 to separate from the plunger 318 by producing enough force to break or release the connector 304 from either the plunger 318 or the push rod 330 due to the retainer 390 holding the plunger 318 from movement in the return direction, thus decoupling the plunger 318. Once decoupled, the plunger 318 has been taken offline and remains stationary. The pump 310 may continue to operate by reciprocating all the push rods 330 but only reciprocating the plungers 318 that remain coupled to the respective push rods 330.

Figure 4A:
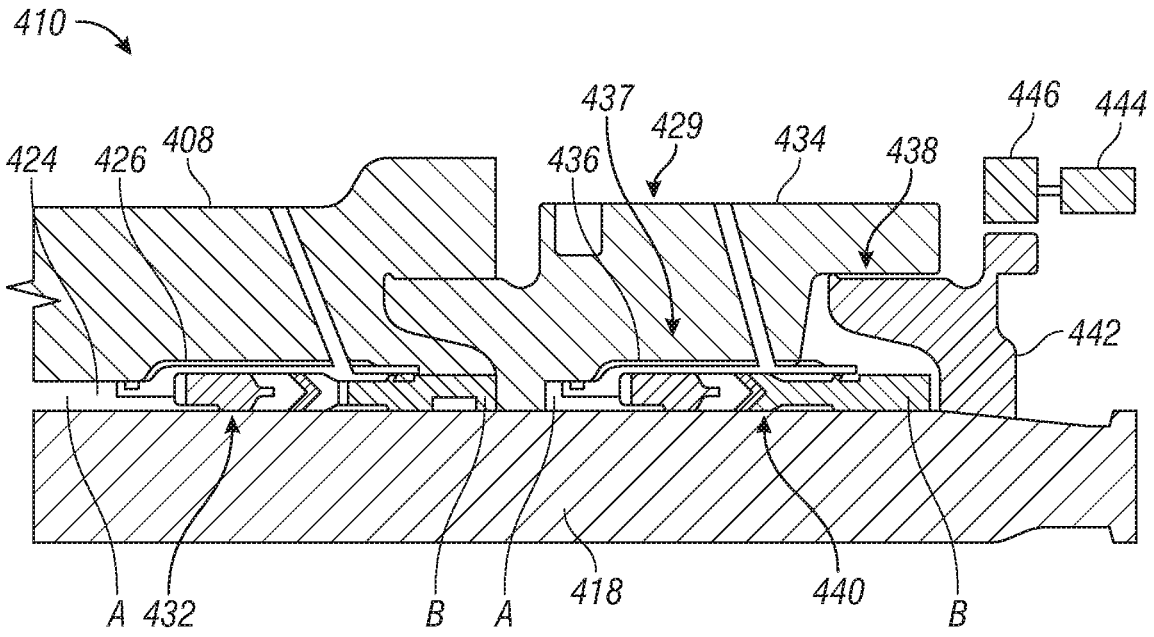
FIGS. 4A-4C are illustrations of embodiments of exemplary packing assemblies for the pump fluid end, according to aspects of the present disclosure.

FIG. 4A is an embodiment of a reciprocating pump 410 with components and operations similar to the reciprocating pumps 106, 210, and 310 discussed above. Similar components are given similar reference numbers as above; e.g., the pump 410 is similar to the pump 310. Since already discussed and for conciseness, not all the discussions of the components or operations will be repeated. The pump 410 includes a fluid end with a fluid end body 408, in which a plunger 418 reciprocates via the operation of a power end (not shown) to reciprocate a push rod (not shown).

For each plunger 418 of the pump 410, the pump 410 includes a packing assembly 429 that includes a dynamic packing 432 in each bore 424 of the fluid end body 408 that surrounds the plunger 418. The dynamic packing 432 may be any suitable type of dynamic packing configured to provide a dynamic seal between a reciprocating plunger 418 and the surrounding bore wall 426. Further, the dynamic packing 432 may include a single component or a combination of components that work together to provide the dynamic seal around the reciprocating plunger 418. For example, the dynamic packing 432 may include chevron seals or any other suitable types of seals. The dynamic packing 432 is designed and oriented to seal against pressure on a pressure side A of the dynamic packing 432 communicated from the pump chamber (not shown). Opposite the pressure side A of each dynamic packing 432 is an atmospheric side B in the direction out of the bore 424 and out of the fluid end body 408.

Each packing assembly 429 also includes a dynamic packing nut 434 surrounding the plunger 418 and threaded into the bore 424 of the body 408. The dynamic packing nut 434 is designed such that, once the dynamic packing 432 is inserted into the bore 424 of the pump fluid end, the dynamic packing nut 434 can be inserted into the bore 424 from the atmospheric side. The dynamic packing nut 434 is then coupled (e.g., threaded together) with the body 408 of the pump fluid end, such that the dynamic packing nut 434 retains the dynamic packing 432 in the pump fluid end during pump operation. Additionally, threading the dynamic packing nut 434 into the body 407 causes the dynamic packing nut 434 to engage with the atmospheric side B of the dynamic packing 432 to energize the dynamic packing 432 into dynamic sealing engagement with the plunger 418. The dynamic packing nut 434 may include slots or holes for the attachment of tools for installing the dynamic packing nut 434 in the body 408. The dynamic packing nut 434 may also include a bore in line with the bore 424 of the body 408 and defined by dynamic packing nut bore wall 436. The dynamic packing nut bore may include a sealing section 437. The dynamic packing nut bore may also include a counterbore section 438 at the atmospheric end of the dynamic packing nut 434 of greater diameter than the sealing section 437.

Each packing assembly 429 also includes a static packing 440 that surrounds the plunger 418 in at least the sealing section 437 of the bore of the dynamic packing nut 434. The static packing 440 may be any suitable type of static packing configured to provide a static seal between a stationary plunger 418 and the surrounding dynamic packing nut bore wall 436. Further, the static packing 440 may include a single component or a combination of components that work together to provide the static seal around the stationary plunger 418. For example, the static packing 440 may include chevron seals or any other suitable types of seals. The static packing 440 is designed and oriented to seal against pressure on a pressure side A of the static packing 440 communicated from the direction of the dynamic packing 432. Opposite the pressure side A of each static packing 440 is an atmospheric side B in the direction out of the counterbore section 438 at the atmospheric end of the dynamic packing nut 434.

As shown in FIG. 4A, each packing assembly 429 also includes a static packing nut 442 surrounding the plunger 418 and threaded into the counterbore section 438 of the dynamic packing nut 434. The static packing nut 442 is designed such that, once the static packing 440 is inserted into the bore of the dynamic packing nut 434, the static packing nut 442 can be inserted into the counterbore section 438 from the atmospheric side. The static packing nut 442 is then coupled (e.g., threaded together) with the dynamic packing nut 434, such that the static packing nut 442 retains the static packing 440 in the dynamic packing nut 434. Additionally, although retaining the static packing 440, the static packing nut 442 does not engage with the atmospheric side B of the static packing 440 during reciprocating operation of the plunger 418 and therefore the static packing 440 is not energized into static sealing engagement with the plunger 418 while the plunger 418 is reciprocating.

As discussed above with respect to FIG. 3, the plunger 418 may be decoupled from a respective push rod to be taken offline and remain stationary while the pump 410 continues to operate and reciprocate the other plungers 418.

One reason the plunger 418 may be taking offline is because the dynamic packing 432 may be degrading and need repair or replacement. Therefore, the dynamic packing 432 is not only not designed for static sealing but the dynamic packing 432 may have degraded past the point of being able to provide an effective seal. To seal against the stationary plunger 418 and allow the pump 410 to continue to operate, the static packing 440 may be energized into static sealing engagement. To energize the static packing 440 into static sealing engagement with the plunger 418, the static packing nut 442 may be further threaded into the dynamic packing nut 434, causing the static packing nut 442 to engage with the atmospheric side B of the static packing 440 to energize the static packing 440 into static sealing engagement with the stationary plunger 418. The static packing nut 442 is threaded into the dynamic packing nut 434 by operating a prime mover; e.g., a motor 444 to rotate a gear 446; e.g., a spur gear or splines, that engages with corresponding gear teeth on an outer surface of the static packing nut 442. The engagement of the gear 446 with the static packing nut 442 allows the gear 446 to cause rotation of the static packing nut 442 and also allows for axial movement of the static packing nut 442 toward the static packing 440. In this manner, the static packing 440 may be retained but deenergized from sealing engagement with the plunger 418 during operation of the pump 410 while the plunger 418 is reciprocating. This deenergizing of the static packing 440 preserves the sealing capability of the static packing 440. Then, when the plunger 418 is taken offline and is stationary such that the dynamic packing 432 may not sufficiently seal the plunger 418, the static packing 440 is energized and provides a seal against the plunger from the pressure in the pump chamber (not shown).

Figure 4B:
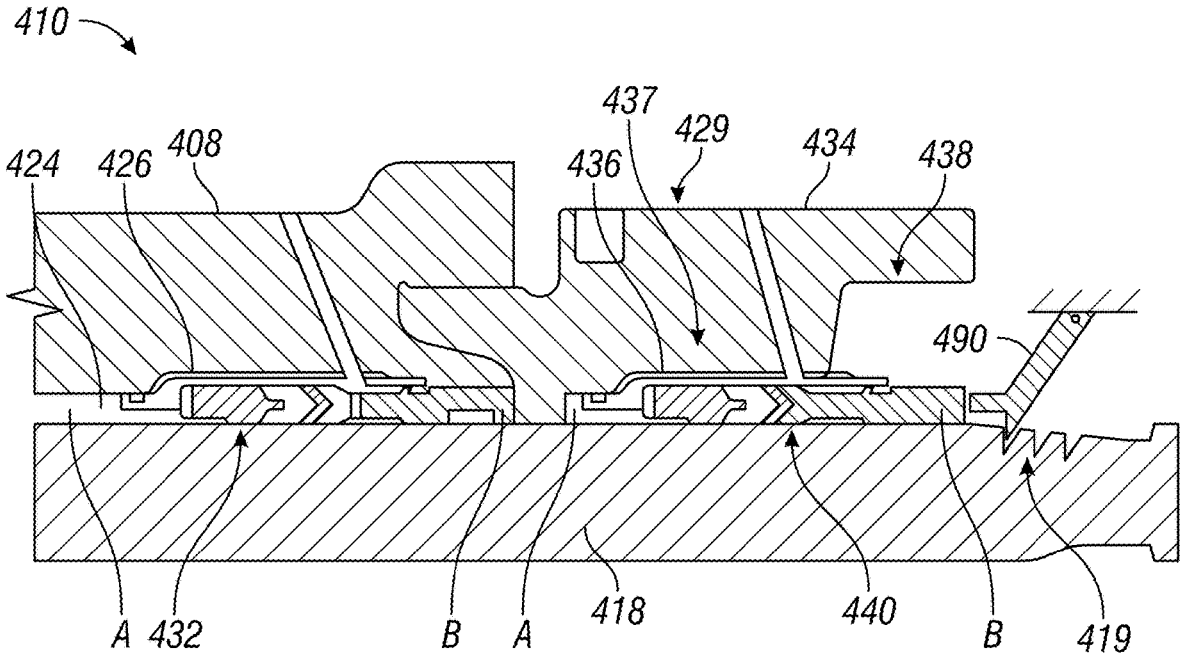

FIG. 4B shows another embodiment of the pump 410 similar to the pump 410 shown in FIG. 4A. However, instead of a static packing nut, the embodiment in FIG. 4B includes a retainer 490 similar to the retainer 390 shown in FIG. 3 but modified so as to be able to engage the static packing 440. As explained above, the retainer 490 is independently operable to selectively engage an engagement profile 419 of the respective plunger 418 to prevent the respective plunger 318 from traveling in the return direction. When the plunger 418 is reciprocating during operation, the retainer 390 is not engaged and therefore the static packing 440 is not energized into static sealing engagement with the plunger 418.

As discussed above with respect to FIG. 3, the plunger 418 may be decoupled from a respective push rod to be taken offline and remain stationary while the pump 410 continues to operate and reciprocate the other plungers 418. To seal against the stationary plunger 418 and allow the pump 410 to continue to operate, the static packing 440 may be energized into static sealing engagement. To energize the static packing 440, the retainer 490 is moved into engagement with the engagement profile 419 of the plunger 418 to retain the plunger 418. Doing so also places a portion of the retainer 490 into engagement with the atmospheric side B of the static packing 440 to energize the static packing 440 into static sealing engagement with the stationary plunger 418. In this manner, the static packing 440 may be retained but deenergized from sealing engagement with the plunger 418 during operation of the pump 410 while the plunger 418 is reciprocating. Then, when the plunger 418 is taken offline and is stationary, the static packing 440 is energized and provides a seal against the plunger from the pressure in the pump chamber (not shown).

Figure 4C:
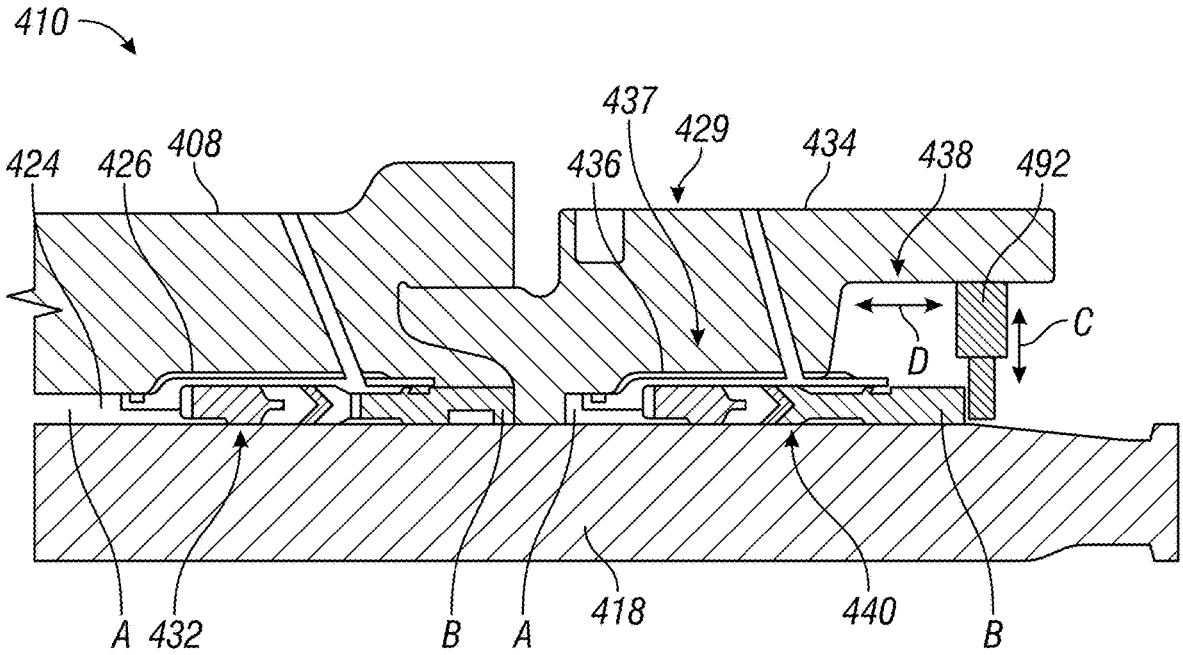

FIG. 4C shows another embodiment of the pump 410 similar to the pump 410 shown in FIG. 4A. However, instead of a static packing nut, the embodiment in FIG. 4C includes a dynamic packing nut 434 with an actuator 492 that is actuatable to engage the static packing 440. The actuator 492 is retractable in the vertical direction C to allow for the insertion of the static packing 440 into the bore of the dynamic packing nut 434. Once the static packing 440 is inserted, the actuator 492 can be extended in the downward direction as shown such that the actuator 492 retains the static packing 440 in the dynamic packing nut 434. Although retaining the static packing 440, the actuator 492 does not engage with the atmospheric side B of the static packing 440 during reciprocating operation of the plunger 418 and therefore the static packing 440 is not energized into static sealing engagement with the plunger 418 while the plunger 418 is reciprocating.

As discussed above with respect to FIG. 3, the plunger 418 may be decoupled from a respective push rod to be taken offline and remain stationary while the pump 410 continues to operate and reciprocate the other plungers 418. To seal against the stationary plunger 418 and allow the pump 410 to continue to operate, the static packing 440 may be energized into static sealing engagement. To energize the static packing 440, the actuator 492 is moved in the axial direction D with respect to the plunger 418. The actuator 492 is thus moved into engagement with the atmospheric side B of the static packing 440 to energize the static packing 440 into static sealing engagement with the stationary plunger 418. The actuator 492 may be moved by any suitable power source, including hydraulic power, electric power, or even manually if needed. In this manner, the static packing 440 may be retained but deenergized from sealing engagement with the plunger 418 during operation of the pump 410 while the plunger 418 is reciprocating. Then, when the plunger 418 is taken offline and is stationary, the static packing 440 is energized and provides a seal against the plunger from the pressure in the pump chamber (not shown).

Figure 5:
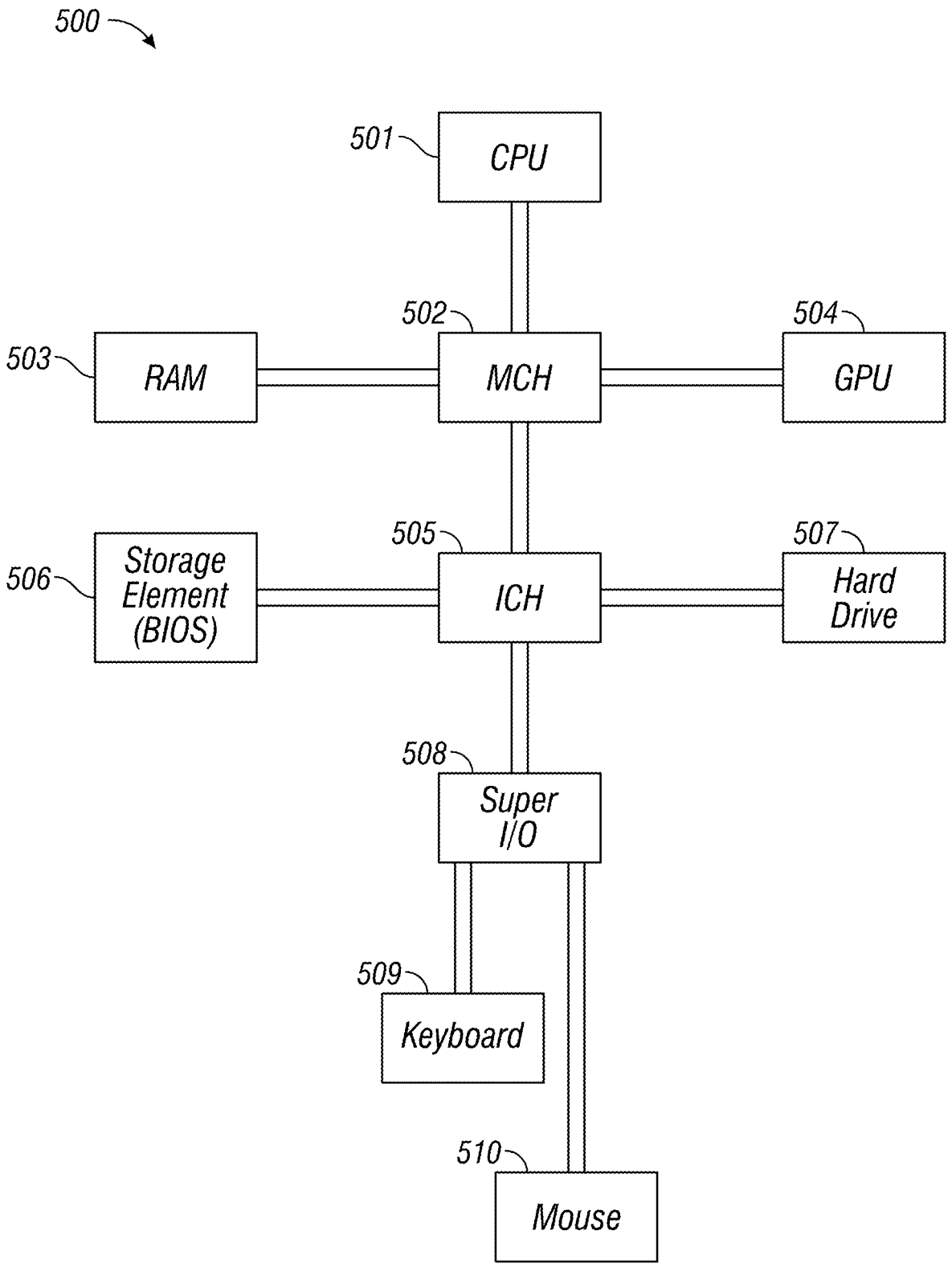
FIG. 5 is a diagram illustrating an example information handling system, according to aspects of the present disclosure.

FIG. 5 is a diagram illustrating an example information handling system 500, according to aspects of the present disclosure. The controller 152 of FIG. 1 may take a form similar to the information handling system 500. A processor or central processing unit (CPU) 501 of the information handling system 500 is communicatively coupled to a memory controller hub or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. The processor 501 may be configured to interpret and/or execute program instructions or other data retrieved and stored in any memory such as memory 503 or hard drive 507. Program instructions or other data may constitute portions of a software or application for carrying out one or more methods described herein. Memory 503 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or an application may be retrieved and stored in the memory 503 for execution by the processor 501.

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in some embodiments, functionality associated with components of information handling system 500 may be implemented in special purpose circuits or components. In other embodiments, functionality associated with components of information handling system 500 may be implemented in configurable general-purpose circuit or components. For example, components of information handling system 500 may be implemented by configured computer program instructions.

Memory controller hub (MCH) 502 may include a memory controller for directing information to or from various system memory components within the information handling system 500, such as memory 503, storage element 506, and hard drive 507. The memory controller hub 502 may be coupled to memory 503 and a graphics processing unit 504. Memory controller hub 502 may also be coupled to an I/O controller hub (ICH) or south bridge 505. ICH 505 is coupled to storage elements of the information handling system 500, including a storage element 506, which may comprise a flash ROM that includes a basic input/output system (BIOS) of the computer system. The ICH 505 is also coupled to the hard drive 507 of the information handling system 500. The ICH 505 may also be coupled to a Super I/O chip 508, which is itself coupled to several of the I/O ports of the computer system, including keyboard 509 and mouse 510.

Examples of the above aspects include:

Example 1 is a reciprocating pump system comprising a fluid end comprising plungers configured to be reciprocated within respective bores in a body; dynamic packings in each of the bores and configured to be energized into dynamic sealing engagement around respective plungers against pressure from a pressure side; dynamic packing nuts engageable with atmospheric sides of respective dynamic packings opposite the pressure side to energize the respective dynamic packings; and static packings in each of the dynamic packing nuts and configured to be energized by mechanical force into static sealing engagement around respective plungers against pressure from a pressure side, wherein while the plungers are reciprocating within the bores, the dynamic packings are energized by the dynamic packing nuts and the static packings are deenergized, and wherein when a plunger is not being reciprocated, the respective static packing is energized into static sealing engagement with the respective plunger.

Example 2 includes the aspects of any preceding examples or combinations thereof and further includes the pump system further comprising static packing nuts engageable with respective dynamic packing nuts and an atmospheric side of respective static packings opposite the pressure side to energize the respective dynamic packings.

Example 3 includes the aspects of any preceding examples or combinations thereof and further includes the pump system further comprising retainers independently operable to engage an atmospheric side of respective static packings opposite the pressure side to energize the respective dynamic packings.

Example 4 includes the aspects of any preceding examples or combinations thereof and further includes the pump system wherein the dynamic packing nuts each comprise an actuator operable to engage an atmospheric side of respective static packings opposite the pressure side to energize the respective dynamic packings.

Example 5 includes the aspects of any preceding examples or combinations thereof and further includes the pump system wherein the fluid end further comprises a pump chamber within the body and the bores extend into the body and into fluid communication with the pump chamber, wherein the plungers are configured to be reciprocated within respective bores by moving in a forward direction toward the pump chamber in a forward stroke and in a return direction away from the pump chamber in a return stroke.

Example 6 includes the aspects of any preceding examples or combinations thereof and further includes the pump system wherein the dynamic packing nuts are engageable with the dynamic packings by being threaded into the body.

Example 7 includes the aspects of any preceding examples or combinations thereof and further includes the pump system wherein the static packing nuts are engageable with respective dynamic packing nuts by being threaded into the dynamic packing nuts.

Example 8 includes the aspects of any preceding examples or combinations thereof and further includes the pump system wherein the static packing nuts are threaded using a motor.

Example 9 includes the aspects of any preceding examples or combinations thereof and further includes the pump system further comprising a power source operable to reciprocate push rods, each push rod releasably coupled to a respective plunger, wherein reciprocation of the push rods reciprocates the plungers within the bores.

Example 10 is a method of operating a reciprocating pump comprising: reciprocating plungers in bores of a fluid end; dynamically sealing the plungers with dynamic packings in the bores against pressure on a pressure side of the dynamic packings while the plungers are reciprocating and while static packings are deenergized; selectively decoupling an identified plunger from a respective push rod such that the identified plunger is stationary; and energizing the respective static packing for the identified plunger into static sealing engagement with the stationary plunger.

Example 11 includes the aspects of any preceding examples or combinations thereof and further includes the method wherein dynamically sealing the plungers comprises engaging atmospheric sides of dynamic packings opposite the pressure sides with dynamic packing nuts to energize the dynamic packings into dynamic sealing engagement with the plungers.

Example 12 includes the aspects of any preceding examples or combinations thereof and further includes the method wherein energizing the respective static packing comprises engaging an atmospheric side of the respective static packing opposite the pressure side with a static packing nut.

Example 13 includes the aspects of any preceding examples or combinations thereof and further includes the method wherein engaging with the static packing nut comprises threading the static packing nut into a dynamic packing nut using a motor.

Example 14 includes the aspects of any preceding examples or combinations thereof and further includes the method wherein energizing the respective static packing comprises engaging an atmospheric side of the respective static packing opposite the pressure side with an independently operable retainer.

Example 15 includes the aspects of any preceding examples or combinations thereof and further includes the method further comprising engaging a dynamic packing nut with the fluid end and wherein energizing the respective static packing comprises engaging an atmospheric side of the respective static packing opposite the pressure side with an actuator of the dynamic packing nut.

Example 16 is a fluid end for a reciprocating pump system comprising: plungers configured to be reciprocated within respective bores in a body; dynamic packings in each of the bores and configured to be energized into dynamic sealing engagement around respective plungers against pressure from a pressure side; dynamic packing nuts engageable with atmospheric sides of respective dynamic packings opposite the pressure side to energize the respective dynamic packings; and static packings in each of the dynamic packing nuts and configured to be energized by mechanical force into static sealing engagement around respective plungers against pressure from a pressure side, wherein while the plungers are reciprocating within the bores, the dynamic packings are energized by the dynamic packing nuts and the static packings are deenergized, and wherein when a plunger is not being reciprocated, the respective static packing is energized into static sealing engagement with the respective plunger.

Example 17 includes the aspects of any preceding examples or combinations thereof and further includes the fluid end further comprising static packing nuts engageable with respective dynamic packing nuts and an atmospheric side of respective static packings opposite the pressure side to energize the respective dynamic packings.

Example 18 includes the aspects of any preceding examples or combinations thereof and further includes the fluid end further comprising retainers independently operable to engage an atmospheric side of respective static packings opposite the pressure side to energize the respective dynamic packings.

Example 19 includes the aspects of any preceding examples or combinations thereof and further includes the fluid end wherein the dynamic packing nuts each comprise an actuator operable to engage an atmospheric side of respective static packings opposite the pressure side to energize the respective dynamic packings.

Example 20 includes the aspects of any preceding examples or combinations thereof and further includes the fluid end wherein the static packing nuts are engageable with respective dynamic packing nuts by being threaded into the dynamic packing nuts using a motor.

Certain terms are used throughout the description and claims to refer to particular features or components. As one skilled in the art will appreciate, different persons may refer to the same feature or component by different names. This document does not intend to distinguish between components or features that differ in name but not function.

For the aspects and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various aspects of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of information. Such a user interface can be operated in conjunction with the communications unit and the bus. Various components of the system can be integrated such that processing identical to or similar to the processing schemes discussed with respect to various aspects herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The aspects disclosed should not be interpreted, or otherwise used, as limiting the scope of the disclosure, including the claims. It is to be fully recognized that the different teachings of the aspects discussed may be employed separately or in any suitable combination to produce desired results. In addition, one skilled in the art will understand that the description has broad application, and the discussion of any aspect is meant only to be exemplary of that aspect, and not intended to suggest that the scope of the disclosure, including the claims, is limited to that aspect.

What is claimed is:

1. A reciprocating pump system comprising:

a fluid end comprising:

a body;

a plurality of plungers, each plunger reciprocable within a corresponding bore in the body;

for each plunger, a dynamic packing disposed in the bore around the plunger and configured to be energized into dynamic engagement around the plunger against pressure from a pressure side;

for each plunger, a dynamic packing nut engageable with an atmospheric side of the dynamic packing opposite the pressure side to energize the dynamic packing; and a static packing in each dynamic packing nut configured to be energized by mechanical force into static sealing engagement around the plunger against pressure from a pressure side, wherein when one of the plungers is being reciprocated, the dynamic packing corresponding to that plunger is energized by the dynamic packing nut and the static packing corresponding to that plunger is deenergized, and wherein when one of the plungers is no longer being reciprocated, the static packing corresponding to that plunger is energized into static sealing engagement with the plunger.

2. The pump system of claim 1, further comprising, for each plunger, a static packing nut engageable with the dynamic packing nut corresponding to that plunger and an atmospheric side of the static packing corresponding to that plunger opposite the pressure side to energize the static packing.

3. The pump system of claim 1, further comprising, for each plunger, a retainer independently operable to engage an atmospheric side of the static packing corresponding to that plunger opposite the pressure side to energize the static packing.

4. The pump system of claim 1, wherein, for each plunger, the dynamic packing nut corresponding to that plunger comprises an actuator operable to engage an atmospheric side of the static packing corresponding to that plunger opposite the pressure side to energize the static packing for that plunger.

5. The pump system of claim 1, wherein the fluid end further comprises a pump chamber within the body and the bores extend into the body and into fluid communication with the pump chamber, wherein the plungers are configured to be reciprocated within corresponding bores by moving in a forward direction toward the pump chamber in a forward stroke and in a return direction away from the pump chamber in a return stroke.

6. The pump system of claim 1, wherein the dynamic packing nuts are engageable with the dynamic packings by being threaded into the body.

7. The pump system of claim 1, wherein, for each plunger, the static packing retainer is engageable with the dynamic packing nut corresponding to that plunger by being threaded into the dynamic packing nut.

8. The pump system of claim 7, wherein the static packing nuts are threaded into the dynamic packing nuts using a motor.

9. The pump system of claim 1, further comprising a power source operable to reciprocate push rods, each push rod releasably coupled to the plunger corresponding to that push rod, wherein reciprocation of the push rods reciprocates the plungers within the bores.

10. A method of operating a reciprocating pump comprising:

reciprocating plungers in bores of a fluid end;

dynamically sealing the plungers with dynamic packings in the bores against pressure on a pressure side of the dynamic packings while the plungers are reciprocating and while static packings are deenergized;

selectively decoupling an identified plunger from the push rod corresponding to that plunger such that the identified plunger is stationary; and energizing the respective static packing for the identified plunger into static sealing engagement with the stationary plunger.

11. The method of claim 10 wherein dynamically sealing the plungers comprises engaging atmospheric sides of dynamic packings opposite the pressure sides with dynamic packing nuts to energize the dynamic packings into dynamic sealing engagement with the plungers.

12. The method of claim 10, wherein energizing the respective static packing comprises engaging an atmospheric side of the static packing corresponding to the identified plunger opposite the pressure side with a static packing nut.

13. The method of claim 12, wherein engaging with the static packing nut comprises threading the static packing nut into a dynamic packing nut using a motor.

14. The method of claim 10, wherein energizing the respective static packing comprises engaging an atmospheric side of the static packing corresponding to the identified plunger opposite the pressure side with an independently operable retainer.

15. The method of claim 10, further comprising engaging a dynamic packing nut with the fluid end and wherein energizing the respective static packing comprises engaging an atmospheric side of the static packing corresponding to the identified plunger opposite the pressure side with an actuator of the dynamic static packing nut.

16. A fluid end for a reciprocating pump system comprising:

a body;

a plurality of plungers, each plunger reciprocable within a corresponding bore in the body;

for each plunger, a dynamic packing disposed in the bore around the plunger and configured to be energized into dynamic sealing engagement around the plunger against pressure from a pressure side;

for each plunger, a dynamic packing nut engageable an atmospheric side of the dynamic packing opposite the pressure side to energize the dynamic packing; and a static packing in each dynamic packing nut configured to be energized by mechanical force into static sealing engagement around the plunger against pressure from a pressure side, wherein when one of the plungers is being reciprocated, the dynamic packing corresponding to that plunger is energized by the dynamic packing nut and the static packing corresponding to that plunger is deenergized, and wherein when one of the plungers is no longer being reciprocated, the static packing corresponding to that plunger is energized into static sealing engagement with the plunger.

17. The fluid end of claim 16, further comprising, for each plunger, a static packing nut engageable with the dynamic packing nut corresponding to that plunger and an atmospheric side of the static packing corresponding to that plunger opposite the pressure side to energize the static packing.

18. The fluid end of claim 16, further comprising, for each plunger, a retainer independently operable to engage an atmospheric side of the static packing corresponding to that plunger opposite the pressure side to energize the static packing.

19. The fluid end of claim 16, wherein, for each plunger, the dynamic packing nut corresponding to that plunger comprises an actuator operable to engage an atmospheric side of the static packing corresponding to that plunger opposite the pressure side to energize the static packing for that plunger.

20. The fluid end of claim 16, wherein, for each plunger, the static packing nut is engageable with the dynamic packing nut corresponding to that plunger by being threaded into the dynamic packing nut using a motor.

* * * * *